US005438891A

United States Patent [19]

Batten

[11] Patent Number: 5,438,891

[45] Date of Patent: Aug. 8, 1995

[54] COLLET TYPE FASTENER REMOVAL TOOL

[75] Inventor: Ronald W. Batten, Torrance, Calif.

[73] Assignee: VSI Corporation, Torrance, Calif.

[21] Appl. No.: 270,691

[22] Filed: Jul. 5, 1994

[51] Int. Cl.[6] ..... B25B 21/00

[52] U.S. Cl. ..... 81/56; 81/57.14

[58] Field of Search ..... 81/54–56, 81/57.11–57.14, 57.3

[56] References Cited

U.S. PATENT DOCUMENTS

| | | | |
|---|---|---|---|
| 2,728,365 | 12/1955 | Austin | 81/54 |
| 2,789,597 | 4/1957 | Torre | 81/55 |
| 3,247,741 | 4/1966 | Batten | 81/56 |
| 3,460,408 | 8/1969 | Raymond | 81/54 X |
| 4,721,022 | 1/1988 | Batten | 81/57.14 X |

*Primary Examiner*—D. S. Meislin
*Attorney, Agent, or Firm*—Plante & Strauss

[57] ABSTRACT

There is disclosed a power driven tool for the removal of locking collars of the frangible fasteners used in the aerospace industry. The tool has a drive motor and gear housing with a stationary sleeve which projects from the housing. Within the stationary sleeve are mounted a rotationally driven outer member that distally bears a lead screw and that slidably receives a stationary, telescoping inner member with a spring to bias the inner member into its extended configuration, and a detent to capture the inner member in its contracted, working configuration. A key holder is mounted on the end of the stationary inner member which has a hexagonally broached center bore that receives a key having has an annular groove which receives a detent ball that is secured by a sliding bushing which surrounds the key holder and a spring which biases the bushing into the detent position. The collet clutch has an internally threaded axial bore which is received over the lead screw of the rotational outer member, and is rotationally indexed to a surrounding collet sleeve. The collet sleeve is engaged through a unidirectional clutch to the stationary sleeve of the housing. When a key is to be replaced, the telescoping inner member is extended by releasing its detent, exposing the key holder to permit one to retract the key detent sleeve and free the key for removal.

10 Claims, 6 Drawing Sheets

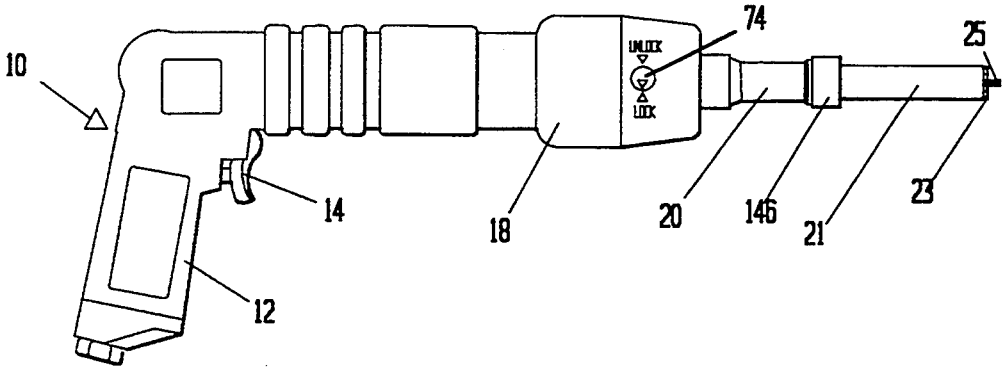
FIGURE 1
FIGURE 7
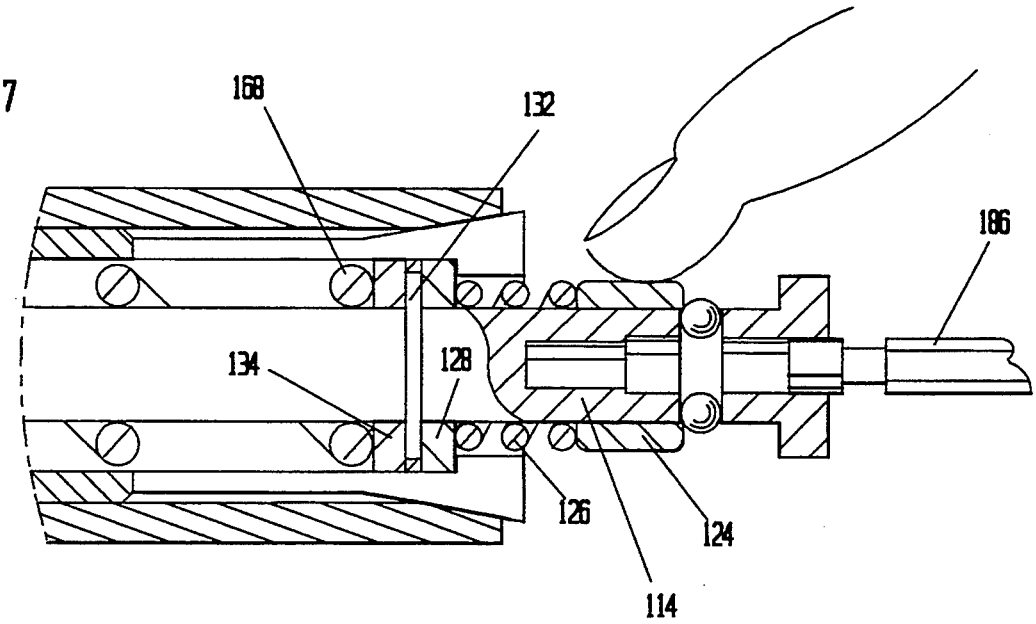

COLLET TYPE FASTENER REMOVAL TOOL

BACKGROUND OF THE INVENTION

1. Field of the invention

This invention relates to a wrenching tool useful for removal of collars of fasteners, and in particular, to a tool with a telescoping key holder for ease of replacement of keys of the tool.

2. Brief Statement of the Prior Art

Frangible fasteners are used extensively in the aerospace industry. These fasteners employ a threaded locking collar which is joined by a notched neck to a wrenching ring which shears from the collar when the applied torque exceeds a predetermined torsional loading. Often the threaded locking collar has an upset portion, usually a slightly elliptical shape to provide a frictional spring lock that prevents the collar from spinning off in the event that the residual tension on the fastener is lost.

These fasteners are applied with wrenching tools which engage the wrenching ring to apply the threaded collar and twist the wrenching ring from the threaded collar when the predetermined torsional loading is exceeded.

It is frequently desirable to loosen or remove threaded locking collars from assembled fasteners. In my prior patents, U.S. Pat. Nos. 4,862,773 and 5,095,779, I have disclosed power driven and manual tools which have a collet chuck to grip and remove fastener collars.

These tools are provided with a central, hexagonally flatted, stationary key which is received in a hexagonal recess in the end of the pin of the fastener to immobilize the pin. The power tool disclosed in my prior patent U.S. Pat. No. 4,862,773 uses a quick disconnect key having a detent system which is disclosed in my prior patent U.S. Pat. No. 4,538,483. While this detent mechanism facilitates replacement of worn or broken keys, difficulty is experienced when a key breaks within the collet chuck leaving a broken end which is not readily accessible.

OBJECTIVES OF THE INVENTION

It is an objective of this invention to provide a power driven removal tool for collars of fasteners.

It is also an objective of this invention to provide a removal tool with replaceable keys to immobilize the fastener pins and permit removal of the collars of fasteners.

It is an additional objective of this invention to provide a quick disconnect detent to retain keys in the removal tool.

It is likewise an objective of this invention to provide a removal tool having a key holder which can be extended to provide access to the key detent during replacement of a key.

It is a further objective of this invention to provide the aforementioned removal tool in a compact configuration.

Other and related objectives will be apparent from the following description of the invention.

BRIEF DESCRIPTION OF THE INVENTION

The invention is a power driven tool for the removal of locking collars of the frangible fasteners used in the aerospace industry. The tool has a drive motor and gear housing with a stationary sleeve which projects from the housing. Within the stationary sleeve are mounted a rotationally driven outer member that distally bears a lead screw and that slidably receives a stationary, telescoping inner member with a spring to bias the inner member into its extended configuration, and a detent to capture the inner member in its contracted, working configuration. A key holder is mounted on the end of the stationary inner member which has a hexagonally broached center bore that receives a key having has an annular groove which receives a detent ball that is secured by a sliding bushing which surrounds the key holder and a spring which biases the bushing into the detent position. The collet clutch has an internally threaded axial bore which is received over the lead screw of the rotational outer member, and is rotationally indexed to a surrounding collet sleeve. The collet sleeve is engaged through a unidirectional clutch to the stationary sleeve of the housing. When a key is to be replaced, the telescoping inner member is extended by releasing its detent, exposing the key holder to permit one to retract the key detent sleeve and free the key for removal.

BRIEF DESCRIPTION OF THE DRAWINGS

The invention will be described with reference to the FIGURES of which:

FIG. 1 illustrates a power-driven wrench equipped with the removal tool of the invention;

FIG. 7 is an enlarged view of the area within line 7–7' of FIG. 6.

DESCRIPTION OF PREFERRED EMBODIMENT

Figure 2:
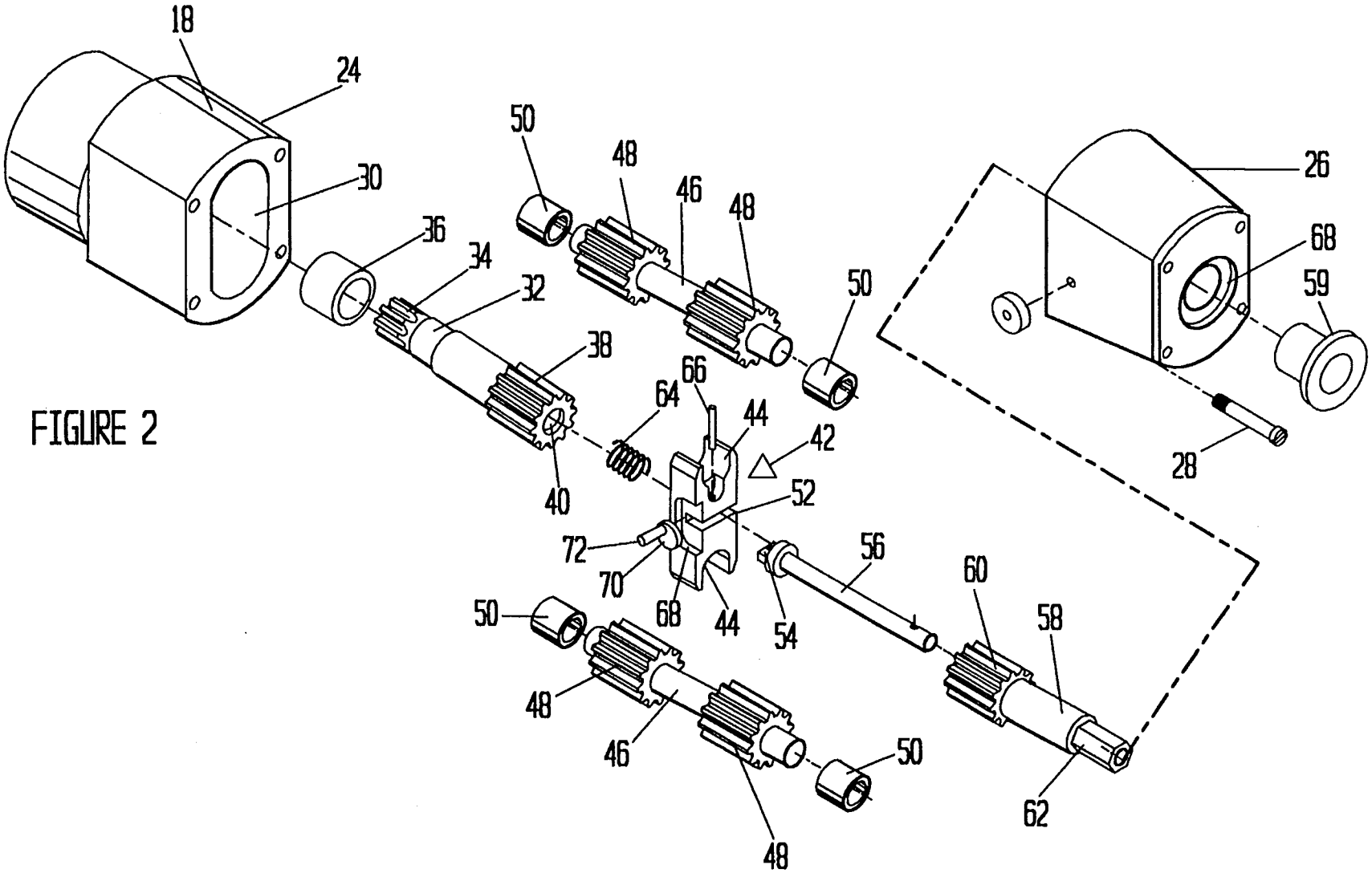
FIG. 2 is an exploded, perspective view of the gears of the driver, as modified to include a mechanism for locking the telescoping member of the tool.

Referring to FIG. 1, the invention is applied to a power driver 10 which has a conventional pistol grip 12 with a trigger control 14 and a drive motor housing 16 which typically houses an air motor. The output shaft of the air motor is engaged in a gear train within gear housing 18. The gear housing supports a stationary sleeve 20 which is secured to the gear housing 18 and which houses the removal tool components of the invention. The end of the tool has a collet clutch which is formed of an outer collet sleeve 21 and a collet chuck 23 which can be seen projecting a slight distance beyond the end of the collet sleeve 21. A stationary key 25 is centrally received in the tool assembly.

Referring now to FIG. 2, there is illustrated an exploded view of the gear train which is within the gear housing 18. The gear housing 18 is formed of opposite housing ends 24 and 26 which are secured together by retaining screws 28. The housing 18 has a generally rectangular internal cavity 30. The input drive shaft 32 for the gear train assembly has a splined end 34 which is received by the power output shaft (not shown) of the air motor. The shaft 32 is rotationally received in a central bore (not shown) in the inside end wall of the gear housing end 24 and is provided with a suitable bearing 36. The opposite end of the input shaft has a wide faced spur gear 38 having a central bore 40 which receives a compression spring 64. A slide block 42 which has a shape closely conforming to the housing cavity 30 of the gear housing 18, and distal arcuate notches 44 is slidably mounted in the housing cavity 30. Each notch 44 provides clearance for a shaft 46 which distally carries a pair of wide faced spur gears 48, identical to gear 38. The shafts 46 are mounted in needle bearings 50 which are received in bores (not shown) in the inside wall of the housing end 24 and the inside wall of housing end 26. The forward face of the slide block 42 has a cross slot 52 and this cross slot receives the flatted end 54 of shaft 56 which is secured thereto by pin 66 that is seated in a bore in the slide block 42 and an aligned bore in the end 54 of shaft 56. Shaft 56 receives power output sleeve 58 which has a wide-faced spur gear 60 which is driven by gears 48, and a hexagonal form 62 at its opposite end. Sleeve 58 is received in bearing 59 which is seated in the end wall of housing end 26.

The resulting assembly of the described parts provides a gear train assembly in which the power output sleeve 58 is rotationally driven through the assembly of spur gears and shaft 56 is rotationally restrained by the slide block 42. The slide block 42 and shaft 56 are slidably mounted in the assembly such that they can be axially displaced against the resilient bias of the spring 64.

The aforedescribed construction is conventional in power driven fastener tools. This assembly, however, is modified in accordance with the teachings of my prior patent, U.S. Pat. No. 4,721,022, to incorporate a cam mechanism on the slide block. This is shown as a cam guide 68 which is milled into one side of the slide block 42. A cam 70 is mounted within the housing 28 on a cam shaft 72 that is received in an aperture 75 bored into the side wall of the housing end 26 and positioned to locate the cam 70 in the cam guide 68. A control knob 74 is mounted on the shaft 72, exteriorly of the housing end 26. From this description, it can be seen that rotation of the control knob 74 on the shaft 72 will move the slide block axially in the assembly, retracting or extending the shaft 56 in the housing 18.

Figure 3:
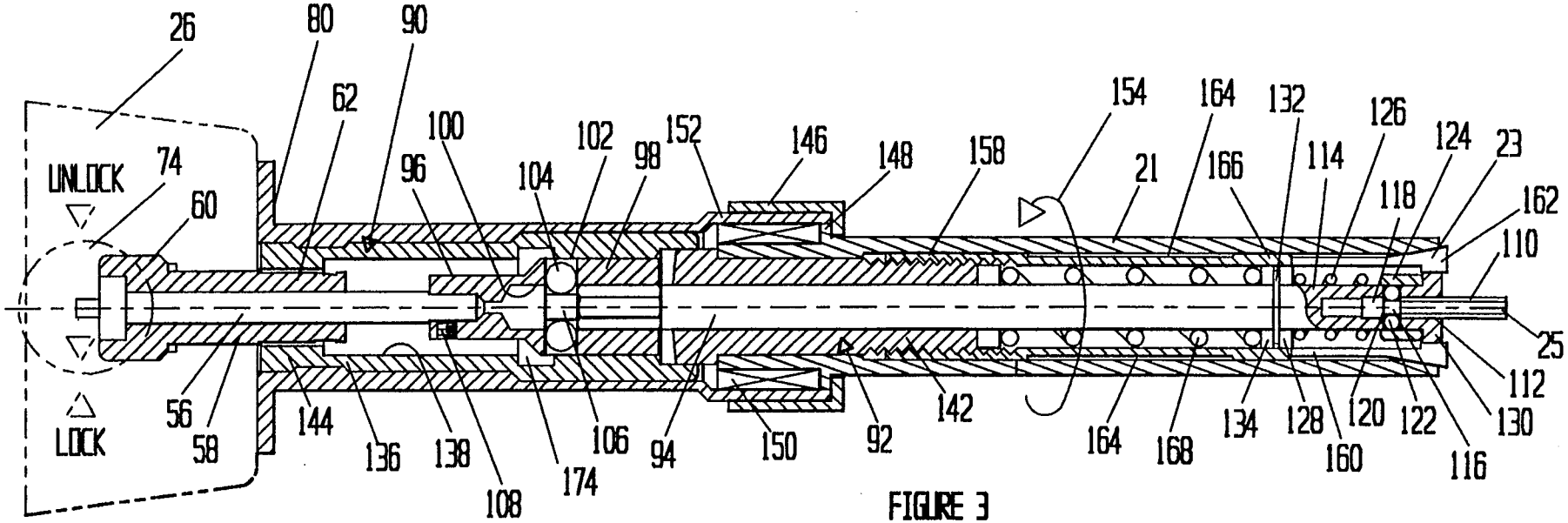
FIG. 3 is an elevational sectional view of the removal tool in a key-locked configuration.

Referring now to FIG. 3, the collet removal tool of the invention will be described. The front half 26 of the gear housing and control knob 74 are shown in phantom lines. The housing end 26 supports, on its end face, a stationary sleeve 80 which is permanently affixed to the front of the housing end 26. The sleeve 80 receives the rotationally driven outer member 90 and the stationary and telescoping, inner member 92 of the tool. The inner, member 92 is a telescoping assembly of a stationary shaft 94 which is received in a chuck 96 formed by cylindrical sleeve 98 which has a central bore 100 to receive the end of shaft 94, and a transverse bore 102 that receives a pair of detent balls 104 which seat in an annular groove 106 about the received end of shaft 94. The chuck 96 is attached with a set screw 108 to the end of shaft 56 that is received in slot 52 of the sliding block 42; see FIG. 2. In the illustration, control knob 74 is shown in its key-locked position.

At its outer end, the stationary shaft 94 has an integral key holder 114 which receives the removable key 25. The key 25 has a hexagonally flatted shaft 110 which seats in a mating hexagonally broached central bore 112 of the key holder 114. The key also has an annular groove 116 adjacent its inboard end 118. The key holder 114 has a transverse bore 120 which intersects central bore 112, and which receives a pair of detent balls 122 that seat in the annular groove 116 of the key 25, to retain the key 25 in the key holder 114. The detent balls 122 are restrained in their detenting position by a bushing 124 which surrounds the key holder 114 and is axially slidable thereon. A compression spring 126 is captured between retainer washer 128 and the bushing 124 to bias the bushing 124 forward against an annular rim 130 about the end of the shaft 94. The shaft 94 also has a retaining ring 132 which is seated in an annular groove (not shown) between retainer washer 128 and a second retainer washer 134.

The shaft 94 is slidably received in the outer member 90 of the tool which is rotatably mounted in the stationary sleeve 80. The outer member 90 is an assembly of a cylindrical mandrel 136 having a central bore 138 which slidably receives the telescoping inner member 92. The mandrel 136 has an internal hex form and a collet actuating bolt 142 is engaged in the hex end of the mandrel 136. The central bore 138 slidably receives the shaft chuck 96 of the inner member 92. The inboard end 144 of the mandrel 136 has a hexagonally flatted recess which is engaged by the hexagonally flatted form 62 on the end of the drive shaft 58.

The end 152 of the stationary sleeve 80 is flared outwardly to an enlarged diameter and has external threads to receive a coupling sleeve 146 that secures the collet sleeve 21 of the tool. The collet sleeve 21 has an annular flange 148 which is captured by the coupling sleeve 146 and a Torrington unidirectional clutch 150, is received between the inboard end of the collet sleeve 21 and the enlarged end 152 of the stationary sleeve 80 whereby the collet sleeve 21 is freely rotatable in a counterclockwise direction as viewed by the tool user (indicated by the arrowhead line 154), but is restrained against rotation in the opposite direction.

The collet actuating bolt 142 has an externally threaded end 156 with left hand threads and threadably receives the inboard end 158 of the collet chuck 23. The collet chuck 23 is a cylindrical member having a plurality of axial slots 160 on its outboard end. The outboard end also has a tapered base 162 which is received against the mating tapered inside wall of the collet sleeve 21. The collet sleeve also has a plurality of axial slots 164 in its inside wall and the collet chuck 23 has axial ribs 166 which are engaged in the slots of the collet sleeve 21, thereby rotationally indexing these two members. In many applications, the slots 164 and ribs 166 may be omitted, as the compression of the collet by the engaged fastener is sufficient to prevent the collet from spinning within the collet sleeve, without need to rely on a positive rotational index between these members. A compression spring 168 is received about shaft 94 and is captured between a spring retainer washer 170 on the end of the collet actuating bolt 142 and the washer 134 supported by the retaining ring 132.

The chuck 96 has detent balls 104 which seat in the annular groove 106 of the shaft 94 whereby the shaft 94 is retained in the assembly. The mandrel 136 of the outer member 90 has an annular recess 174 on its inside wall which, when aligned with the transverse bore 102 of chuck 96 will permit the balls 104 to move radially outwardly, releasing the telescoping shaft 94 which, under the bias of the spring 168 will move the inner member 92 to its extended position.

In FIG. 3, the collar removal tool of the invention is illustrated in a position suitable for engagement of a collar of a fastener system for the removal of that collar.

Figure 4:
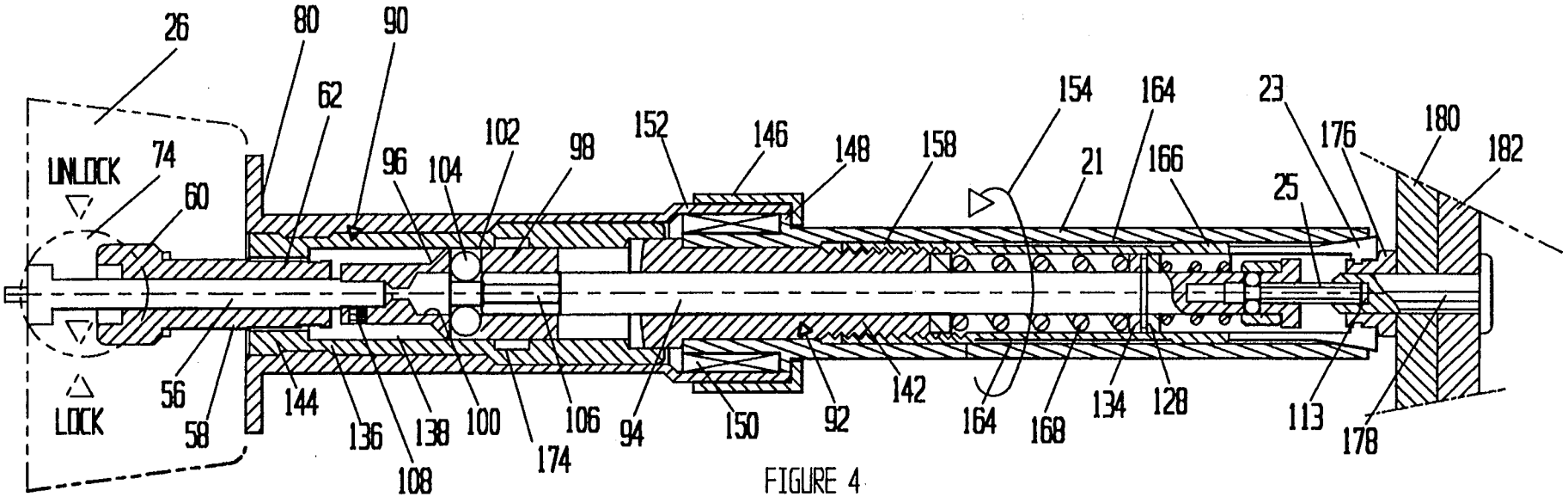
FIG. 4 is an elevational sectional view of the removal tool of the invention as applied for the removal of a fastening collar of an aerospace fastener.

FIG. 4 illustrates the removal tool applied to the collar 176 of a fastener which includes the threaded pin 178 which secures two work members 180 and 182. In the illustration, the jaws 184 of the collet chuck 23 have been placed about the cylindrical fastener collar 176 and the key 25 is inserted in the hexagonally broached recess 113 of the fastener pin 178.

When the tool is powered in counter clockwise rotation, rotating mandrel 136 and collet actuating bolt 142, the collet chuck 23 is withdrawn into the collet sleeve 21 by the threads on the end of the collet actuating bolt 142, compressing the collet jaws 184 against the collar 176. The continued rotation of the collet chuck 23 and collet sleeve 21 will loosen and remove the collar 176 from the fastener pin 178 which is immobilized by the key 25 in the stationary inner member 92.

Figure 5:
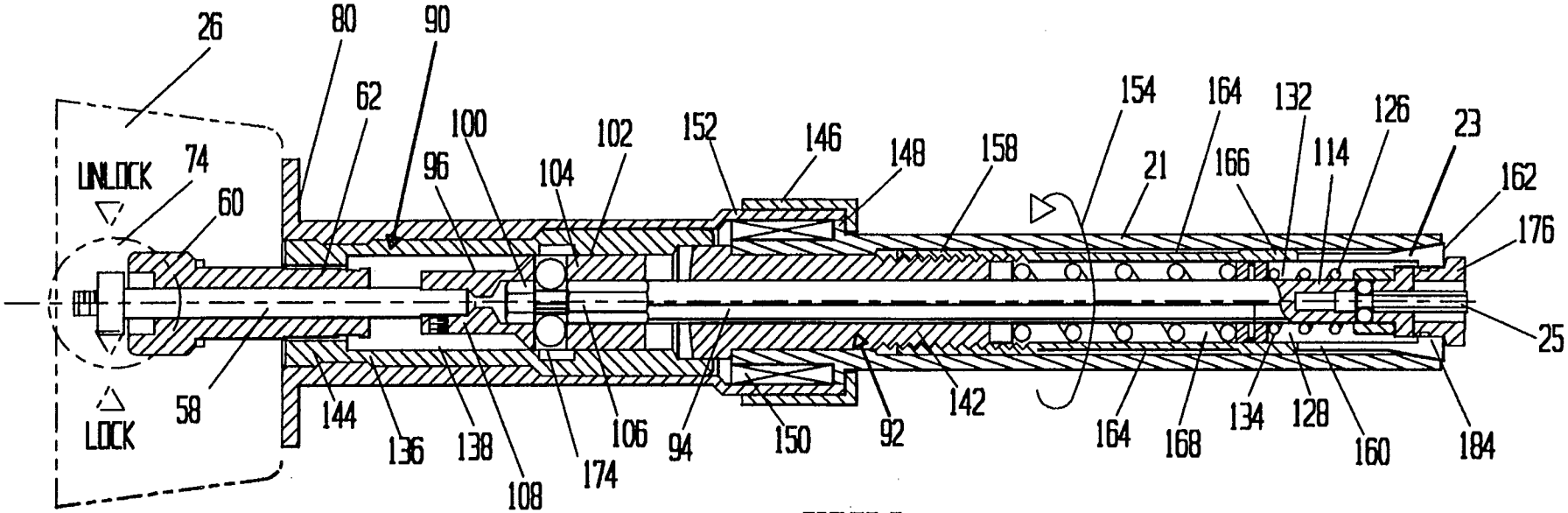
FIG. 5 is an elevational sectional view of the removal tool with a collar which has been removed from a fastener system in the collet jaws of the tool.

Referring now to FIG. 5, the collar removal tool is illustrated with the fastener collar 176 removed from the fastener pin 178 and still secured in the jaws 184 of the collet chuck 23.

The collar is released from the collet chuck by reversing the rotation of the drive motor, which reverses the rotation of the outer member 90 of the tool. As the collet sleeve 21 is locked against opposite rotation by the clutch 150, it remains stationary so that the collet chuck 23 is extended as it is backed off the threaded end of the collet actuating bolt 142. This opens the jaws 184 of the collet chuck 23, releasing the collar 176, which is ejected by inner member 92 from the pressure of spring 168.

Figure 6:
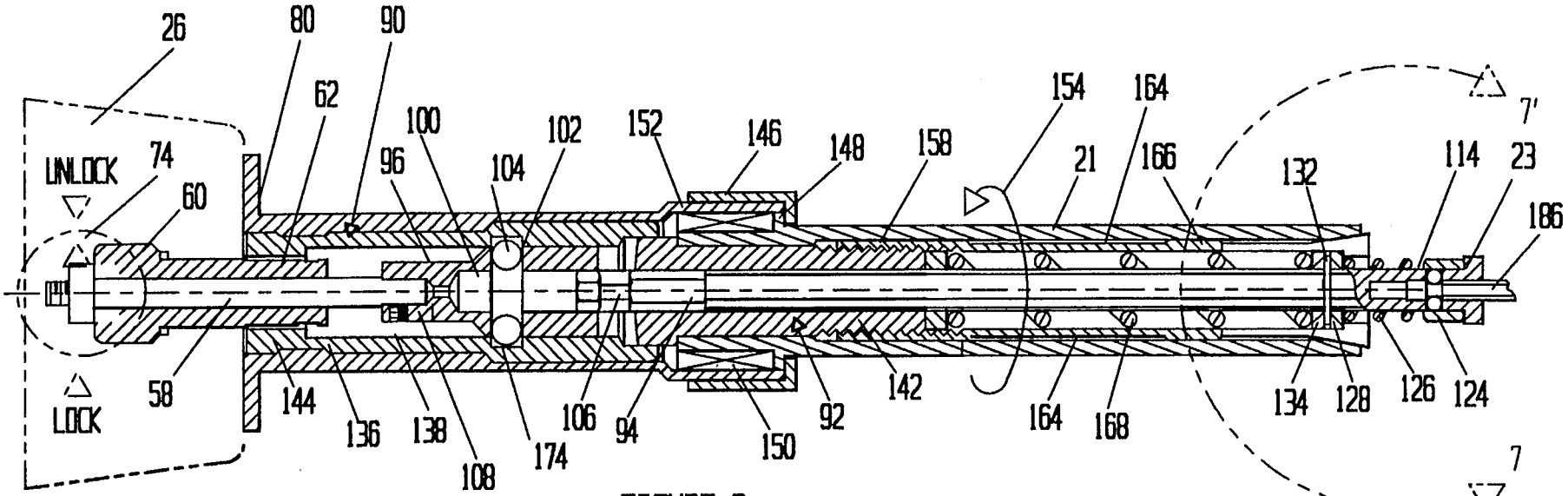
FIG. 6 is an elevational view of the removal tool in the key-unlocked configuration.

Referring now to FIG. 6, there is illustrated the removal tool in its key-unlocked configuration for the removal of a broken or worn key 186. The tool is set to the key-unlocked configuration by rotating the control knob 74 on the housing end 26 to the unlocked position, moving the inner member 92 into the illustrated position with the transverse bore 102 of the chuck aligned with the annular groove 174 of the surrounding mandrel 136. In this position the detent balls 104 are released from the annular groove 106 of the shaft 94, and the shaft is extended by the spring 168 into the extended configuration shown in FIG. 6, where the bushing 124 is exposed for access to the operator. The jaws 184 of the collet chuck 23 stop extension of the shaft 94 when retainer washer 128 abuts the internal shoulder of the jaws.

As shown in FIG. 7, the operator slides the bushing 124 axially to a withdrawn position which permits the detent balls 122 to move radially outwardly out of the annular groove 116 of the key 25, freeing the key 186, which can be withdrawn, as shown in a partially extracted position in FIG. 7. A replacement key can be readily inserted into the flatted bore 112 of the key holder 114 in the configuration illustrated in FIG. 7.

The invention can thus be seen to provide a very facile mechanism for the replacement of broken or damaged keys which would otherwise be extracted only with considerable difficulty, particularly when the keys break at a location within the removal tool in its operable configuration.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. In a driven power tool having a first tool member received concentrically within a surrounding, second tool member and axially moveable therein, drive means to impart relative rotational movement of said first and second tool members, wherein said first tool member is an assembly of a quick disconnect key having a wrenching surface with a distal, annular groove and a key holder having a central recess which receives said key and which has a mating wrenching surface to rotationally index to said key, and wherein said key holder also has a detent recess transversely intersecting said central recess in which is received at least one detent ball which seats in said annular groove of said key to retain said key in said holder, the improvement in quick disconnect means which comprises:

a. a sleeve slidably received about said key holder and moveable between a detent position in which it overlies said detent to recess retain said ball seated in said annular groove and a release position in which it is sufficiently withdrawn from said detent recess to permit said ball to move out of said annular groove of said key;

b. spring means carried on said holder and engaging said sleeve to urge said sleeve into said detent position;

c. second detent means comprising:

(1) a receptacle slidably carried within said second tool member and having a second central recess that receives an end of said first tool member;

(2) second detent means carried by said receptacle to secure said first tool member against axial movement relative to said receptacle;

(3) release means carried on said second tool member and adjacent said second detent means to release said first tool member and permit sufficient axial movement thereof to project said key beyond the end of said second tool member and accessible to permit movement of said sleeve and release of said key.

2. The driven power tool of claim 1 including second spring means biased between said first and second tool members to urge extension of said first tool member upon engagement of said release means.

3. The driven power tool of claim 1 wherein said second detent means comprises a second detent recess located in said receptacle transversely to and intersecting said second central recess, with second detent ball means received therein to seat in said second annular groove of said first tool member.

4. The driven power tool of claim 1 wherein said receptacle is a cylindrical plug and said second central recess is an axial socket having wrenching flats.

5. The driven power tool of claim 1 wherein said first tool member is rotationally immobile and said second tool member is rotationally driven by said drive means.

6. The driven power tool of claim 4 wherein said second tool member coaxially receives said cylindrical plug and said release means comprises an annular recess on the inside wall of said second tool member at a location which can be aligned with said second detent recess to permit movement of said second ball means radially outwardly from said second annular recess, releasing said first tool member for axial movement relative to said receptacle.

7. The driven power tool of claim 1 wherein said second tool member has a collet clutch to engage work pieces.

8. The driven power tool of claim 7 wherein said collet clutch has a threaded engagement with said second tool member.

9. The driven power tool of claim 8 wherein said threaded engagement comprises left hand threads and said tool is operable for the powered removal of collars of threaded collar and pin fasteners.

10. The driven power tool of claim 1 including stop means between said first and second tool members to limit the axial extension of said first tool member within said second tool member.

* * * * *